US011577516B2

(12) United States Patent
Miyazaki

(10) Patent No.: US 11,577,516 B2
(45) Date of Patent: Feb. 14, 2023

(54) LIQUID DISCHARGE APPARATUS

(71) Applicant: Yohei Miyazaki, Kanagawa (JP)

(72) Inventor: Yohei Miyazaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/455,480

(22) Filed: Nov. 18, 2021

(65) Prior Publication Data

US 2022/0203688 A1 Jun. 30, 2022

(30) Foreign Application Priority Data

Dec. 24, 2020 (JP) ..... JP2020-214404

(51) Int. Cl.
*B41J 2/165* (2006.01)

(52) U.S. Cl.
CPC ..... *B41J 2/16544* (2013.01); *B41J 2/16538* (2013.01); *B41J 2/16547* (2013.01); *B41J 2/16505* (2013.01)

(58) Field of Classification Search
CPC ..... B41J 2/16544; B41J 2/16538; B41J 2/16547; B41J 2/16505
See application file for complete search history.

(56) References Cited

U.S. PATENT DOCUMENTS

| | | | | |
|---|---|---|---|---|
| 10,471,720 | B2 * | 11/2019 | Gaston Llado | B41J 2/16538 |
| 2015/0336387 | A1 | 11/2015 | Miyazaki | |
| 2019/0224982 | A1 | 7/2019 | Miyazaki | |

FOREIGN PATENT DOCUMENTS

| | | |
|---|---|---|
| JP | 2003-127403 | 5/2003 |
| JP | 2007-090771 | 4/2007 |
| JP | 2014-172383 | 9/2014 |

* cited by examiner

*Primary Examiner* — Geoffrey S Mruk
(74) *Attorney, Agent, or Firm* — IPUSA, PLLC

(57) ABSTRACT

A liquid discharge apparatus includes a head including a nozzle surface having nozzles, the head configured to discharge a liquid from the nozzles, a head plate holding the head, and a wiping device including a wiper configured to wipe the nozzle surface of the head, a wiper support plate holding the wiper, the wiper support plate vertically movable with respect to the head plate, a cover between the head plate and the wiper support plate, the cover configured to cover the wiper, a lifting device configured to vertically move the wiper support plate and the cover toward the head plate until the cover contacts the head plate, and an adjuster between the wiper support plate and the cover, the adjuster configured to adjust a position of the wiper support plate with respect to the cover.

11 Claims, 9 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2020-214404, filed on Dec. 24, 2020, in the Japan Patent Office, the entire disclosure of which is hereby incorporated by reference herein.

BACKGROUND

Technical Field

Aspects of the present disclosure relate to a liquid discharge apparatus.

Related Art

An inkjet printer includes a cleaning unit in contact with a head lower surface of a discharge head and a unit moving device that moves the cleaning unit in a cleaning direction. The cleaning unit includes a base, a cleaning liquid discharger protruding upward from the base, and a pair of position determinators. The pair of position determinators are in contact with a block lower surface of a head fixing block on both sides of the cleaning liquid discharger.

A head lower gap to hold the cleaning liquid is maintained between the cleaning liquid discharger and the head lower surface. The pair of position determinators is separated from the cleaning liquid discharger. Thus, the inkjet printer can prevent the cleaning liquid or the like spreading from the head lower gap to a periphery from adhering to the block lower surface via the pair of position determinators.

SUMMARY

A liquid discharge apparatus includes a head including a nozzle surface having nozzles, the head configured to discharge a liquid from the nozzles, a head plate holding the head, and a wiping device including a wiper configured to wipe the nozzle surface of the head, a wiper support plate holding the wiper, the wiper support plate vertically movable with respect to the head plate, a cover between the head plate and the wiper support plate, the cover configured to cover the wiper, a lifting device configured to vertically move the wiper support plate and the cover toward the head plate until the cover contacts the head plate, and an adjuster between the wiper support plate and the cover, the adjuster configured to adjust a position of the wiper support plate with respect to the cover.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
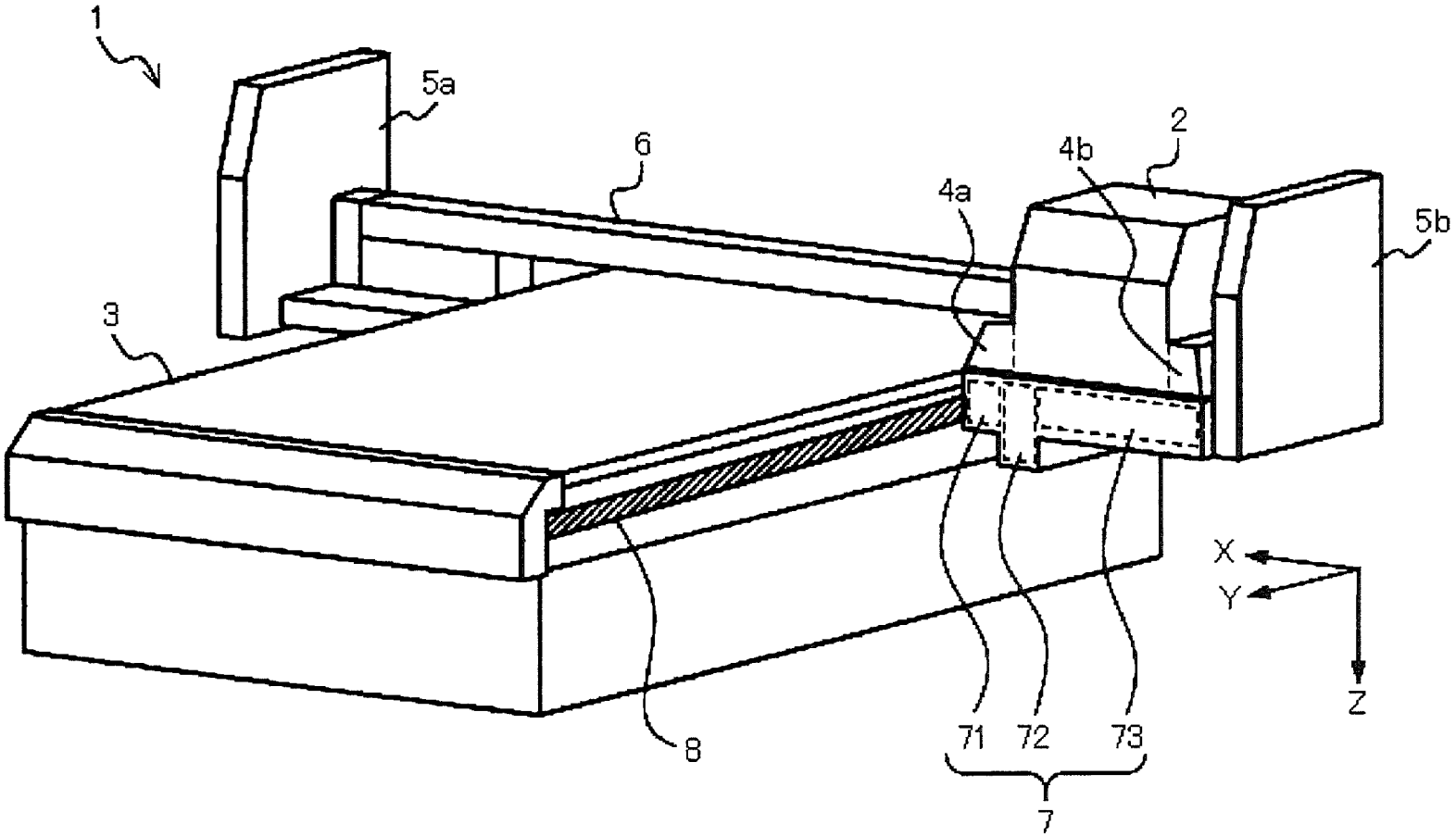
FIG. 1 is a schematic perspective view of a liquid discharge apparatus according to a first embodiment of the present disclosure.

The accompanying drawings are intended to depict embodiments of the present invention and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Referring now to the drawings, embodiments of the present disclosure are described below. As used herein, the singular forms "a", "an", and "the" are intended to include the plural forms as well, unless the context clearly indicates otherwise.

Hereinafter, embodiments of the present invention are described with reference to the drawings.

FIG. 1 is a schematic perspective view of an entire structure of an inkjet recording apparatus as an example of a liquid discharge apparatus according to a first embodiment.

Figure 3:
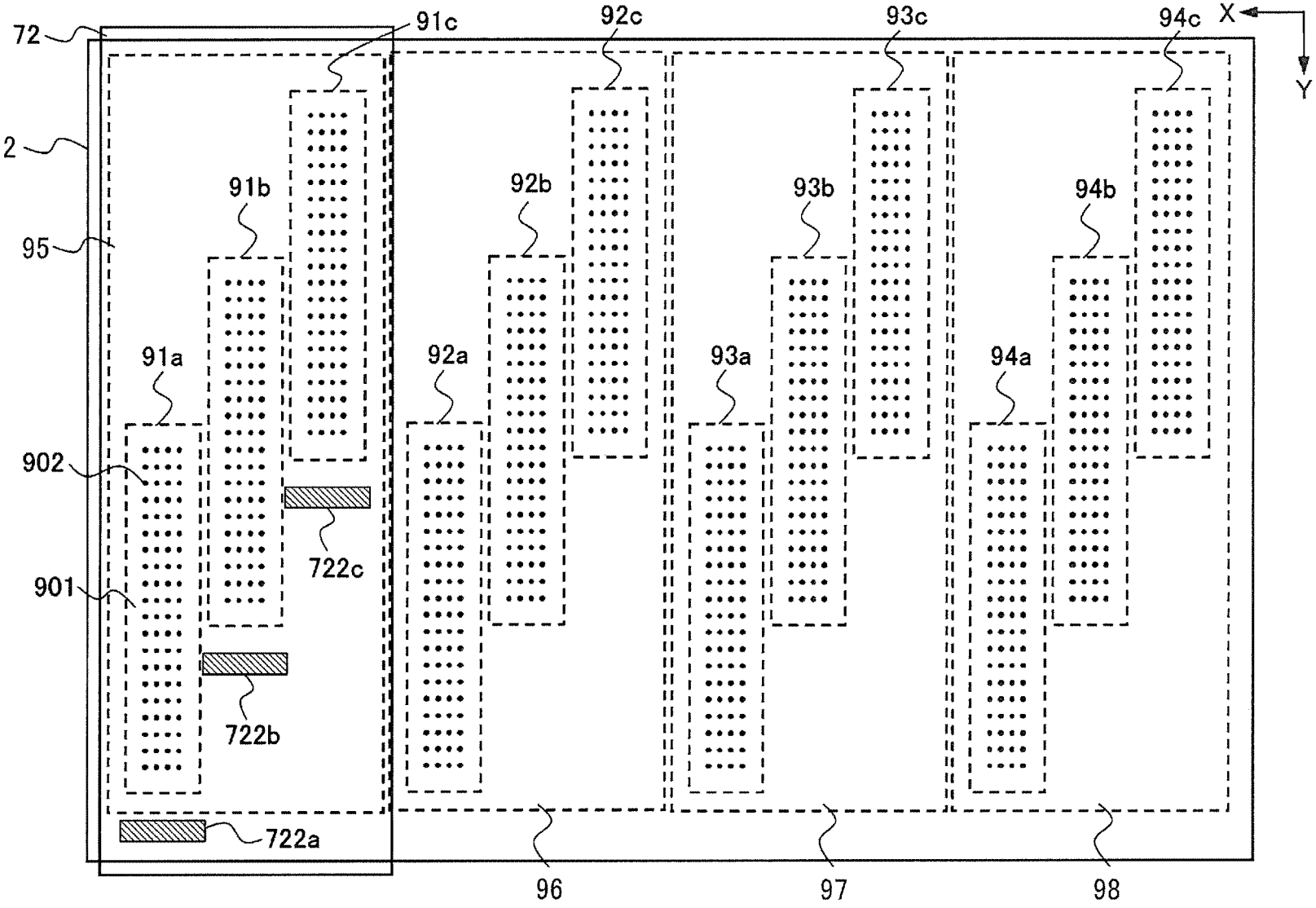
FIG. 3 is a schematic plan view of heads and the wiping device illustrating a relation between wipers of the wiping device and the heads.

The inkjet recording apparatus 1 includes a carriage 2 and a stage 3 to mount a recording medium. The carriage 2 is an inkjet-type carriage including multiple liquid discharge heads 91*a* to 91*c*, 92*a* to 92*c*, 93*a* to 93*c*, and 94*a* to 94*c* as illustrated in FIG. 3. Hereinafter, the "liquid discharge head" is simply referred to as a "head". Further, the heads 91*a* to 91*c*, 92*a* to 92*c*, 93*a* to 93*c*, and 94*a* to 94*c* are collectively referred to as the "heads 91 to 94" below. Each of the head 91 to 94 has a nozzle surface 901 (see FIGS. 9A and 9B) including multiple nozzles 902 (see FIG. 3). The carriage 2 holds the heads 91 to 94 such that the nozzle surface 901 faces an upper surface of the stage 3.

In this first embodiment, the inkjet recording apparatus 1 includes irradiators 4*a* and 4*b* on both sides of the carriage 2. The irradiators 4*a* and 4*b* include light sources to irradiate the recording medium with ultraviolet rays since the liquid to be used in the inkjet recording apparatus 1 is a liquid having ultraviolet curing properties. The irradiators 4*a* and 4*b* emit light having a wavelength that cures the liquid discharged from the nozzles 902 of the heads 91 to 94. The inkjet recording apparatus 1 includes a left-side plate 5*a* and a right-side plate 5*b* to support a guide rod 6. The guide rod 6 movably holds the carriage 2 so that the carriage 2 is movable in an X-direction (main-scanning direction) as indicated by "X" in FIG. 1.

The inkjet recording apparatus 1 according to the first embodiment is not limited to a liquid discharge apparatus using a liquid having ultraviolet curing properties. For example, the liquid discharge apparatus using a liquid that does not have ultraviolet curing properties may not include the irradiators 4*a* and 4*b*.

Further, the inkjet recording apparatus 1 includes a maintenance device 7 at a position away from the upper surface of the stage 3. The upper surface of the stage 3 is a mounting surface of the recording medium).

The maintenance device 7 includes a purge receiver 71, a wiping device 72, a cap 73, and the like. The maintenance device 7 performs a maintenance process on the heads 91 to 94 in a state in which the carriage 2 is at a position facing the maintenance device 7. For example, the purge receiver 71 receives a liquid discharged from the heads 91 to 94 not used for forming (recording) an image on the recording medium on the stage 3. This discharge process is also referred to as a purging process or a dummy discharge process. The wiping device 72 wipes (cleans) the nozzle surface 901 of the heads 91 to 94 by a cleaner such as a wiper. The cap 73 sucks out a liquid (ink) or the like remaining in the nozzles 902 of the heads 91 to 94.

The carriage 2, the irradiators 4*a* and 4*b*, the guide rod 6, the side plates 5*a* and 5*b*, and the maintenance device 7 are moved together as a single body in a Y-direction (sub-scanning direction) along a guide rail 8 below the stage 3. The Y-direction (sub-scanning direction) is indicated by an arrow "Y" in FIG. 1. Further, the carriage 2 and the irradiators 4*a* and 4*b* are also movable in a Z-direction (vertical direction) indicated by an arrow "Z" in FIG. 1.

The inkjet recording apparatus 1 having the above configuration moves the carriage 2 and the irradiators 4*a* and 4*b* with respect to the recording medium placed on the stage 3 in an X-Y direction to record an image or the like on the recording medium on the stage 3. The carriage 2 is an example of a liquid discharge device, and the wiping device 72 is an example of a cleaner. Hereinafter, a configuration of the wiping device 72 is described below in detail.

Figure 2:
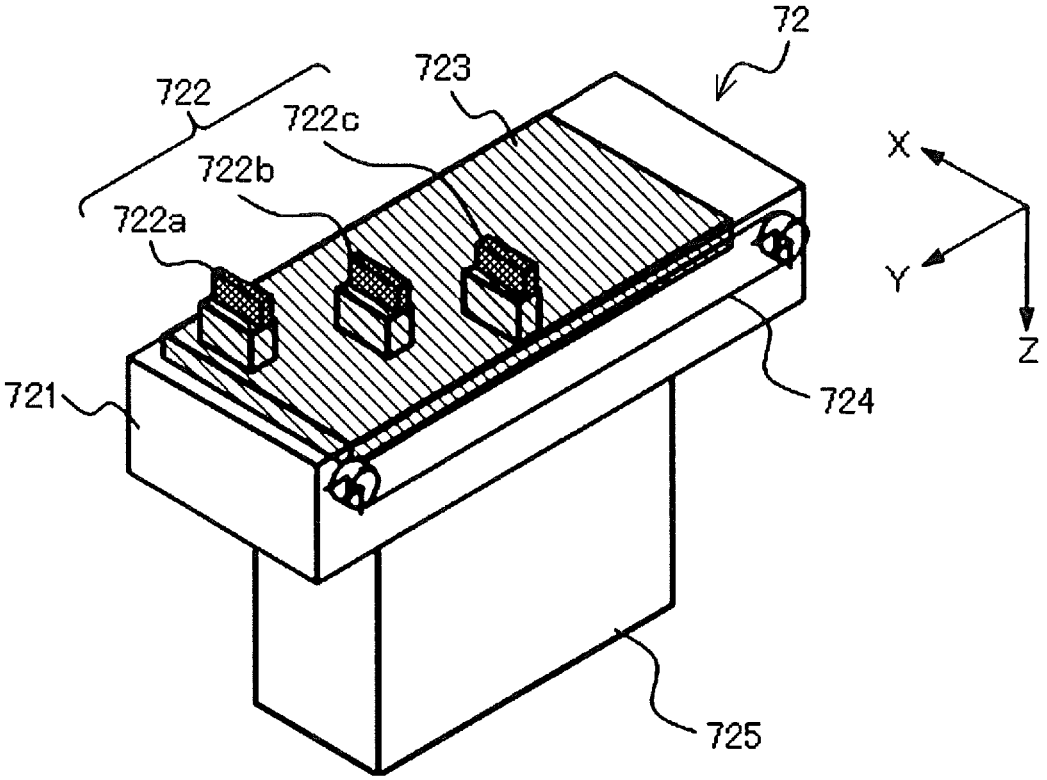
FIG. 2 is a schematic external perspective view of a wiping device.

FIG. 2 is a schematic external perspective view of the wiping device 72.

The wiping device 72 includes a housing 721, wipers 722*a*, 722*b*, and 722*c* protruding from an upper surface of the housing 721, and a wiper support plate 723 supporting the wipers 722*a*, 722*b*, and 722*c*. Here, the wipers 722*a*, 722*b*, and 722*c* are examples of cleaning members, and the wiper support plate 723 is an example of a cleaning member support member.

These wipers 722*a* to 722*c* are collectively referred to as a "wipers 722" in the following description. The wiper support plate 723 is coupled to a drive belt 724, a rotation direction of which is switchable between a normal rotation and a reverse rotation. The rotation direction of the drive belt 724 is switched to move the wipers 722 to a positive-side in the Y-direction and a negative-side in the Y-direction.

Further, the housing 721 is coupled to a lifting device 725. The lifting device 725 is driven to move the housing 721 to a positive-side in the Z-direction and a negative-side in the Z-direction. An elevation mechanism of the lifting device 725 may be configured by various well-known techniques such as a configuration using a screw shaft, a configuration using an eccentric cam, and a configuration using a link device. Here, the lifting device 725 is an example of a lifter.

The lifting device 725 having an above-described configuration moves the housing 721 to the negative-side in the Z-direction to bring the wipers 722 close to the heads 91 to 94 to clean the nozzle surfaces 901 of the heads 91 to 94. Then, the drive belt 724 is driven to move the wipers 722 to the negative-side in the Y-direction to wipe and clean the nozzle surface 901 of the head 91 to 94 by the wipers 722.

FIG. 3 is a schematic plan view of the heads 91 to 94 and the wiping device 72 illustrating a relation between the wipers 722 of the wiping device 72 and the heads 91 to 94.

The carriage 2 includes four head modules 95 to 98. The head modules 95 to 98 respectively include the heads 91 to 94. The heads 91 to 94 includes three heads 91*a* to 91*c*, 92*a* to 92*c*, 93*a* to 93*c*, and 94*a* to 94*c*, respectively. For example, the head module 91 has a configuration in which the three heads of the head 91*a*, the head 91*b*, and the head 91*c* are disposed in a staggered manner. Each of the heads 91 to 94 has a nozzle surface 901 including the multiple nozzles 902 from each of which the liquid is dischargeable. The multiple nozzles 902 form four nozzle arrays in the X-direction (main-scanning direction). The nozzle 902 is an example of a liquid discharge port. The nozzle surface 901 is an example of a liquid discharge surface.

The head module 95 in this example discharges white ink from all of the heads 91 (91*a*, 91*b*, and 91*c*). The head 92*a* in the head module 92 includes four rows of the nozzle arrays. Two nozzle arrays of the head 92*a* on a left side in the X-direction discharges cyan ink, and two nozzle arrays of the head 92*a* on a right side in the X-direction discharges magenta ink. Similar to the head 92*a*, the heads 92*b* and 92*c* discharges cyan ink from the two nozzle arrays on the left side of the heads 92*b* and 92*c* and discharges magenta ink from the two nozzle arrays on the right side of the heads 92*b* and 92*c*.

The head 93*a* in the head module 93 includes four rows of the nozzle arrays. Two nozzle arrays of the head 93*a* on a left side in the X-direction discharges yellow ink, and two nozzle arrays of the head 93*a* on a right side in the X-direction discharges black ink.

Similar to the head 93*a*, the heads 93*b* and 93*c* discharges yellow ink from the two nozzle arrays on the left side of the heads 92*b* and 93*c* and discharges black ink from the two nozzle arrays on the right side of the heads 93*b* and 93*c*. Further, the heads 94*a* and 94*b* discharges clear ink, and the head 94*c* discharges primers (base materials) in the head module 94.

As illustrated in FIG. 3, a position of the carriage 2 is controlled so that the wipers 722 of the wiping device 72 respectively correspond to the heads 91 to 94 to clean the nozzle surfaces 901 of the heads 91 to 94 on the carriage 2. For example, the wipers 722*a* to 722*c* respectively correspond to heads 91*a* to 91*c* of the head module 95 in FIG. 3. Then, the wipers 722 are moved to the negative-side in the Y-direction to wipe and clean the nozzle surfaces 901 of the heads 91 to 94. When a cleaning of a first head module 95 is completed, the carriage 2 is moved by a predetermined distance in the X-direction, and a cleaning of the next head module 96 is performed. The above wiping (cleaning) operation are repeated until all heads 91 to 94 in the head modules 95 to 98 have been wiped (cleaned).

Types and a number of colors of ink used in each head 91 to 94 are not limited to the types and the number of colors of ink as described above. For example, one head may discharge three colors (three types) of inks. Alternatively, all the heads 91 to 94 may discharge the same color (one type) of ink.

A number and an arrangement of the nozzles 902 on the nozzle surface 901 are not limited to the number and the arrangement of the nozzles 902 as described above. The heads 91 to 94 according to the first embodiment includes four nozzle arrays as an example as illustrated in FIG. 3. However, the heads 91 to 94 may include three or less nozzle arrays or may include five or more nozzle arrays. Further, the head 91 to 94 may include a single nozzle without forming a row (array) of nozzles 902.

Further, a number and an arrangement of the wipers 722 of the wiping device 72 are not limited to the number and the arrangement of the wipers 722 as described above. The wiping device 72 according to the first embodiment includes three wipers 722*a* to 722*c* as illustrated in FIG. 3. However, a configuration of the wiping device 72 may be appropriately changed based on a nozzle arrangement of the heads 91 to 94.

Figure 4B:
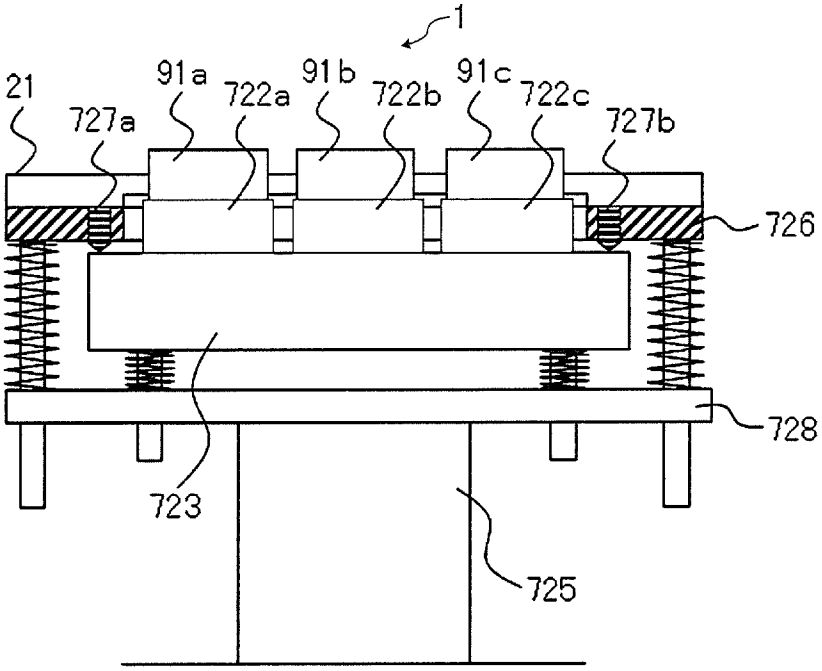
FIGS. 4A and 4B are schematic cross-sectional views of the wiping device and the heads illustrating a wiping (cleaning) operation of the wiping device.
Figure 4A:
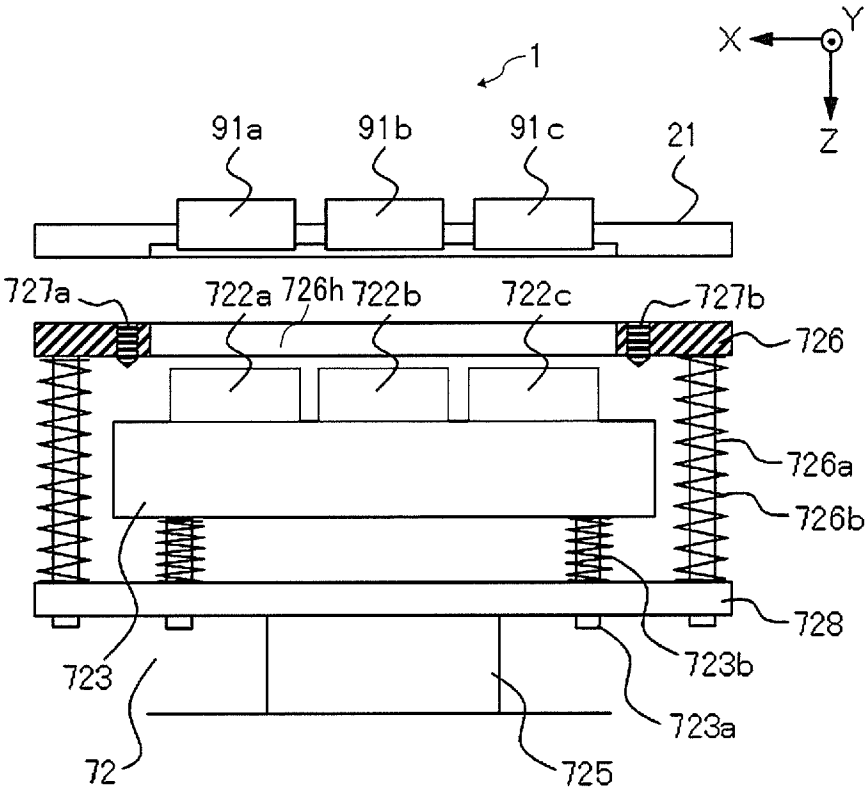

FIGS. 4A and 4B are schematic cross-sectional views of the wiping device 72 and the heads 91 illustrating a wiping (cleaning) operation of the wiping device 72.

FIG. 4A is a schematic cross-sectional view of the wiping device 72 in a non-cleaning state.

FIG. 4B is a schematic cross-sectional view of the wiping device 72 in a cleaning state.

FIGS. 4A and 4B illustrate a state in which the wipers 722*a*, 722*b*, and 722*c* respectively face the heads 91*a*, 91*b*, and 91*c*. The head plate 21 holds the heads 91*a*, 91*b*, and 91*c* such that the nozzle surfaces 901 of the heads 91*a*, 91*b*, and 91*c* face downward. The head plate 21 is, for example, a part of the head modules 95 to 98 or a part of the carriage 2 as described above. Here, the head plate 21 is an example of a liquid discharge surface holder.

The wiping device 72 includes a base plate 728 and the lifting device 725. The lifting device 725 holds the base plate 728 to lift and drop the base plate 728. The base plate 728 supports a wiper support plate 723 that supports the wipers 722.

The wiper support plate 723 includes a support rod 723*a* and a compression spring 723*b*. The compression spring 723*b* is attached to the support rod 723*a*. The compression spring 723*b* pushes the wiper support plate 723 in a direction away from the base plate 728 (negative-side in the Z-direction). An upper end of the support rod 723*a* is fixed to the wiper support plate 723 by screwing or the like. A lower end of the support rod 723*a* is configured to be able to pass through a through-hole in the base plate 728 and be pulled out below the base plate 728.

The wiping device 72 includes a wiper cover 726 interposed between the head plate 21 and the wiper support plate 723 to protect the wipers 722 during the non-cleaning state. The base plate 728 also supports the wiper cover 726.

The wiper cover 726 also includes an opening 726*h* (through hole), a support rod 726*a* and a compression spring 726*b* as the wiper support plate 723.

As illustrated in FIGS. 4A and 4B, the wipers 722*a* to 722*c* moves upward and passes through the opening 726*h* (see FIG. 4A and FIG. 6) of the wiper cover 726 to protrude upward from the wiper cover 726 during a wiping (cleaning) operation so that the wipers 722*a* to 722*c* can wipe the nozzle surface 901 of the heads 91 to 94.

The compression spring 726*b* is attached to the support rod 726*a*. The compression spring 726*b* pushes the wiper cover 726 in a direction away from the base plate 728 (negative-side in the Z-direction). An upper end of the support rod 726*a* is fixed to the wiper cover 726 by screwing or the like. A lower end of the support rod 726*a* is configured to be able to pass through a through-hole in the base plate 728 and be pulled out below the base plate 728.

Further, the wiper cover 726 includes adjustment screws 727*a* and 727*b* that are adjustable a protrusion amount of the adjustment screws 727*a* and 727*b* toward the wiper support plate 723. As illustrated in FIG. 4B, the adjustment screws 727*a* and 727*b* can adjust a position of the wiper support plate 723 with respect to the wiper cover 726 at a time of a lifting operation of the wiper support plate 723. Hereinafter, the adjustment screws 727*a* and 727*b* may be collectively referred to as "adjustment screws 727". The adjustment screws 727 serves as an adjuster to adjust the position of the wiper support plate 723 with respect to the wiper cover 726.

Here, the head plate 21 is an example of a liquid-discharge surface holder. The base plate 728 is an example of a base. The wiper support plate 723 is an example of a cleaner supporter. The compression spring 723*b* is an example of a first elastic member. The wiper cover 726 is an example of a cover. The compression spring 726*b* is an example of a second elastic member. Further, the adjustment screw 727*a* and the adjustment screw 727*b* are an example of an adjustment device.

The wiping device 72 having the above-described configuration can raise the base plate 728 by the lifting device 725 during cleaning of the nozzle surfaces 901 of the heads 91 to 94. As the base plate 728 rises, an upper surface of the wiper cover 726 first comes into contact with a lower surface of the head plate 21 so that the wiper cover 726 does not rise any further. The base plate 728 continues to rise further to raise the wiper support plate 723. The wiper support plate 723 rises and stops until the wiper support plate 723 comes into contact with the adjustment screws 727*a* and 727*b* protruding from the lower surface of the wiper cover 726.

The inkjet recording apparatus 1 determines whether the wiper support plate 723 contacts with the adjustment screws 727*a* and 727*b* based on, for example, a feed amount of a screw shaft in the lifting device 725.

Thus, even if the wiping device 72 is slightly inclined with respect to the head plate 21, the wiper cover 726 and the wiper support plate 723 follow an inclination of the wiping device 72 in this order. Thus, the wiping device 72 can maintain the wipers 722 to be parallel with the nozzle surfaces 901 of the heads 91 to 94. That is, the wiping device 72 can maintain a parallelism between the wiper and the nozzle surface 901 and the nozzle surface 901 of the heads 91 to 94.

The wiping device 72 according to the first embodiment includes the adjustment screws 727*a* and 727*b* serving as an adjustment device on the wiper cover 726. However, the present invention is not limited to the embodiment as described above. For example, the wiping device 72 may include the adjustment screws 727*a* and 727*b* on the wiper support plate 723 so that the adjustment screws 727*a* and 727*b* protrude from the wiper support plate 723 toward the wiper cover 726. Further, it is not limited to screws to adjust the height of the wipers 722*a* to 722*c*, and a cam surface such as an eccentric cam may be used to adjust the position (height) of a contact surface of the wiper support plate 723.

Figure 5:
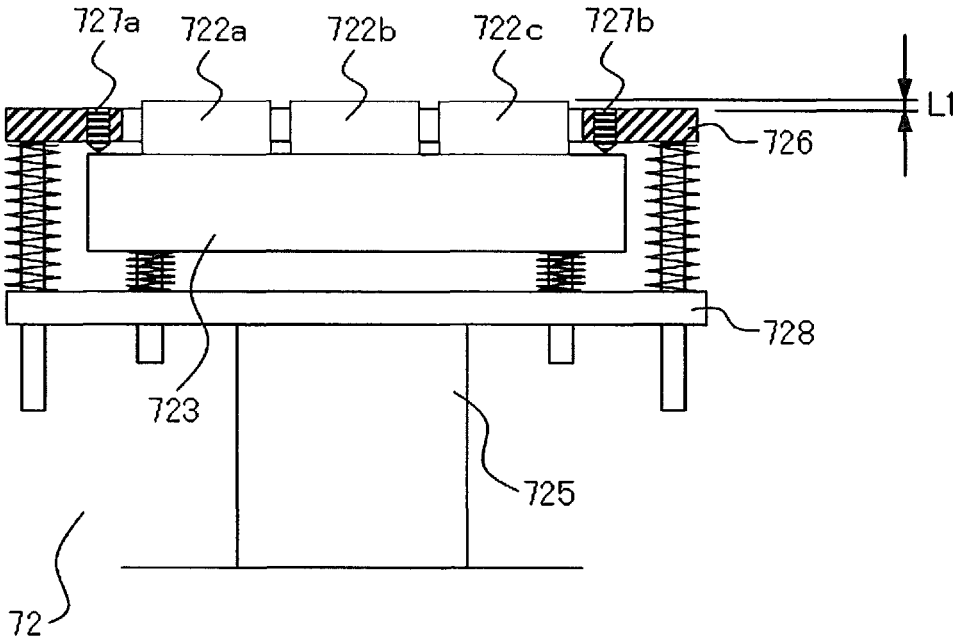
FIG. 5 is a schematic cross-sectional view of the wiping device illustrating a height adjustment of the wiping device.

FIG. 5 is a schematic cross-sectional view of the wiping device 72 illustrating a height adjustment of the wiping device 72.

When the wiping device 72 is mounted on the maintenance device 7, a height of the wipers 722 has to be previously set to an appropriate value to perform desired cleaning. The height of the wipers 722 is determined according to a biting amount L1 of the wipers 722 with respect to the nozzle surfaces 901 of the heads 91 to 94.

Figure 6:
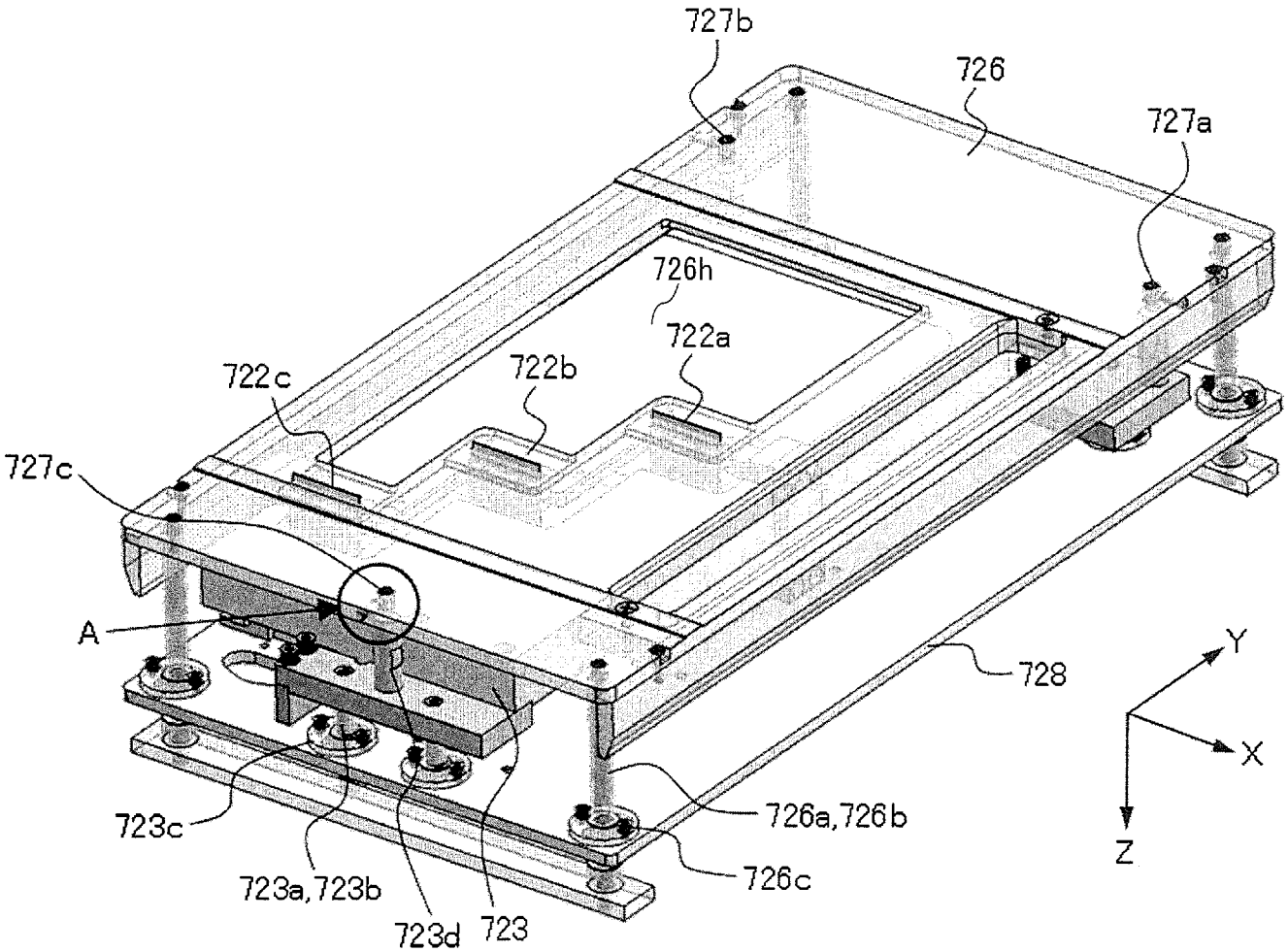
FIG. 6 is a schematic perspective view of a variation (second embodiment) of the wiping device.

The wiping device 72 according to the first embodiment adjusts a protrusion amount of the adjustment screws 727*a* and 727*b* to adjust a protrusion amount (height) of the wipers 722 from the wiper cover 726 to a constant value. Although two adjustment screws 727 (adjustment screws 727*a* and 727*b*) are illustrated in FIG. 5, the wiping device 72 includes an adjustment screw 727*c* serving as an adjustment device at a rear end of the wiper cover 726 as illustrated in FIG. 6 as described below. Thus, the wiping device 72 includes three adjustment screws 727*a* to 727*c* at three positions of the wiper cover 726.

In the wiping device 72 according to the first embodiment, the adjustment screws 727*a*, 727*b*, and 727*c* are minutely adjusted while measuring the protrusion amount (height) of the wipers 722. Thus, the parallelism of the wipers 722 with respect to the head plate 21 can be minutely adjusted (obtained) only by obtaining the accuracy of the wiping device 72 alone. Thus, the wiping device 72 can reduce occurrence of a skill difference of workers in a height adjustment operation of the wipers 722.

The inkjet recording apparatus 1 according to the first embodiment includes the carriage 2 and the wiping device 72. The carriage 2 includes the head plate 21 that holds the nozzle surface 901 of the heads 91 to 94. The wiping device 72 includes the wipers 722 that comes into contact with the nozzle surface 901 of the heads 91 to 94 to clean the nozzle surface 901 of the heads 91 to 94 as described above. The wiping device 72 includes a base plate 728, a lifting device 725, a wiper support plate 723, a compression spring 723*b*, a wiper cover 726, a compression spring 726*b*, and adjustment screws 727*a*, 727*b*, 727*c*. The lifting device 725 holds the base plate 728 to lift and drop the base plate 728.

The wiper support plate 723 includes wipers 722 and is vertically movable with respect to the base plate 728. The compression spring 723*b* pushes the wiper support plate 723 away from the base plate 728. The wiper cover 726 is interposed between the head plate 21 and the wiper support plate 723. The wiper cover 726 covers the wipers 722 that is vertically movable with respect to the base plate 728. The compression spring 726*b* pushes the wiper cover 726 away from the base plate 728. The adjustment screws 727*a*, 727*b*, 727*c* are disposed between the wiper support plate 723 and the wiper cover 726. The adjustment screws 727 adjust the position of the wiper cover 726 and the wiper support plate 723.

Thus, the wiper cover 726 and the wiper support plate 723 follow an inclination of the head plate 21 in this order. Thus, the wiping device 72 can maintain the wipers 722 to be parallel with the nozzle surfaces 901 of the heads 91 to 94. That is, the wiping device 72 can maintain a parallelism between the wipers 722 and the nozzle surface 901 and the nozzle surface 901 of the heads 91 to 94. Thus, the inkjet recording apparatus 1 according to the first embodiment can easily adjust the position of the wipers 722 to be contact with the nozzle surfaces 901 of the heads 91 to 94.

Further, the adjustment screws 727*a*, 727*b*, and 727*c* can adjust the protrusion amount of the adjustment screws 727*a*, 727*b*, and 727*c* with respect to the wiper cover 726 or the wiper support plate 723 as described above.

Thus, the wiping device 72 can merely obtain the accuracy of the wiping device 72 alone to adjust (obtain) the parallelism of the wipers 722 with respect to the head plate 21. Thus, the wiping device 72 can reduce occurrence of a skill difference of workers in a height adjustment operation of the wipers 722.

FIG. 6 is a schematic perspective view of a variation (second embodiment) of the wiping device 72. Members that are the same as or equivalent to the members as described above are denoted by the same reference numerals, and description thereof is omitted.

The three adjustment screws 727*a*, 727*b*, and 727*c* as described above are disposed as illustrated in FIG. 6. The third adjustment screw 727*c* is disposed opposite (negative-side in the Y-direction) to the adjustment screws 727*a* and 727*b*.

In this wiping device 72 according to the variation (second embodiment), each leading ends of the adjustment screws 727*a*, 727*b*, and 727*c* do not directly contact with (abut) an upper surface of the wiper support plate 723. Alternatively, the leading ends of the adjustment screws 727*a*, 727*b*, and 727*c* directly contact with (abut) the pin 723*d* (see FIG. 7) on the wiper support plate 723. A detailed configuration of the pin 723*d* is described below.

The wiper support plate 723 includes the pin 723*d*, and the lifting device 725 is configured to vertically move the wiper support plate 723 and the wiper cover 726 toward the head plate 21 until the wiper cover 726 contacts the head plate 21 and the pin 723*d* of the wiper support plate 723 contacts the adjustment screws 727.

Further, the wiping device 72 according this variation (second embodiment) includes guide bushes 723*c* and 726*c* at portions of the base plate 728 through each of which the support rod 723*a* of the wiper support plate 723 passes and portions of the base plate 728 through each of which the support rod 726*a* of the wiper cover 726 passes as illustrated in FIG. 6.

The guide bushes 723*c* and 726*c* prevent a "biting" that occurs when a load is applied to the support rod 723*a* or the support rod 726*a* in an oblique direction. Details of the biting is described below. Here, a term "biting" refers to a state in which members come into close contact with each other and become immovable due to frictional heat generated at a portion through which a rod (the support rod 723*a* or the support rod 726*a*) passes.

Figure 7:
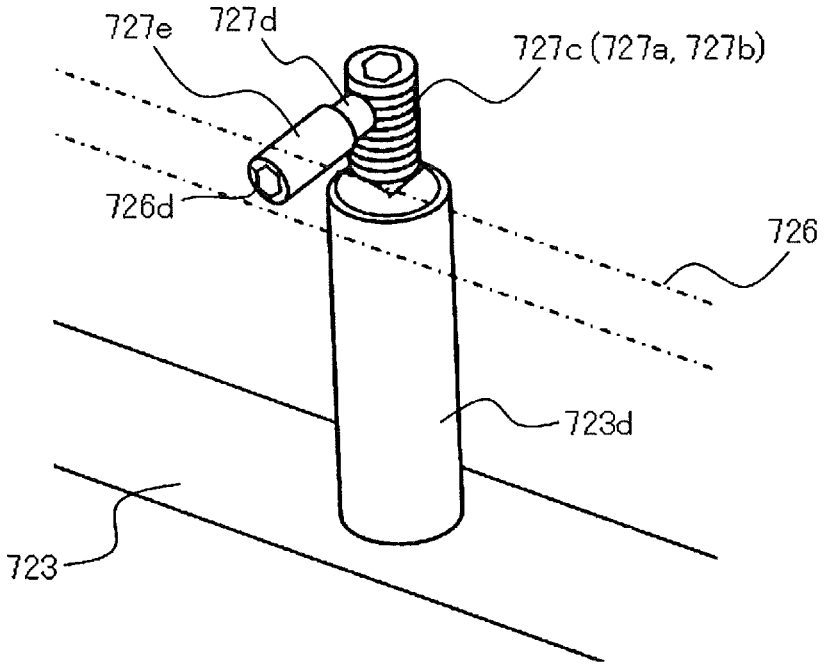
FIG. 7 is a schematic view of a portion of the wiping device illustrating a configuration around an adjustment screw.

FIG. 7 is a schematic view of a portion of the wiping device 72 illustrating a configuration around the adjustment screw 727.

FIG. 7 is an enlarged view of a portion "A" in FIG. 6, and other two portions (adjustment screws 727*a* and 727*b*) have the same configuration with the adjustment screw 727 illustrated in FIG. 7.

The leading end of the adjustment screw 727*c* abuts against an upper surface of the pin 723*d* on the wiper support plate 723. The wiping device 72 includes a lateral hole 726*d* leading to the adjustment screw 727*c* on a side surface of the wiper cover 726 near the adjustment screw 727*c*. A set piece 727*d* is inserted into the lateral hole 726*d*, and a fixing screw 727*e* is tightened to press the set piece 727*d* against the adjustment screw 727*c*. Thus, the adjustment screw 727*c* after fine adjustment is less likely to loosen.

An adhesive may be injected from the lateral hole 726*d* instead of the set piece 727*d* and the fixing screw 727*e*.

Figure 8:
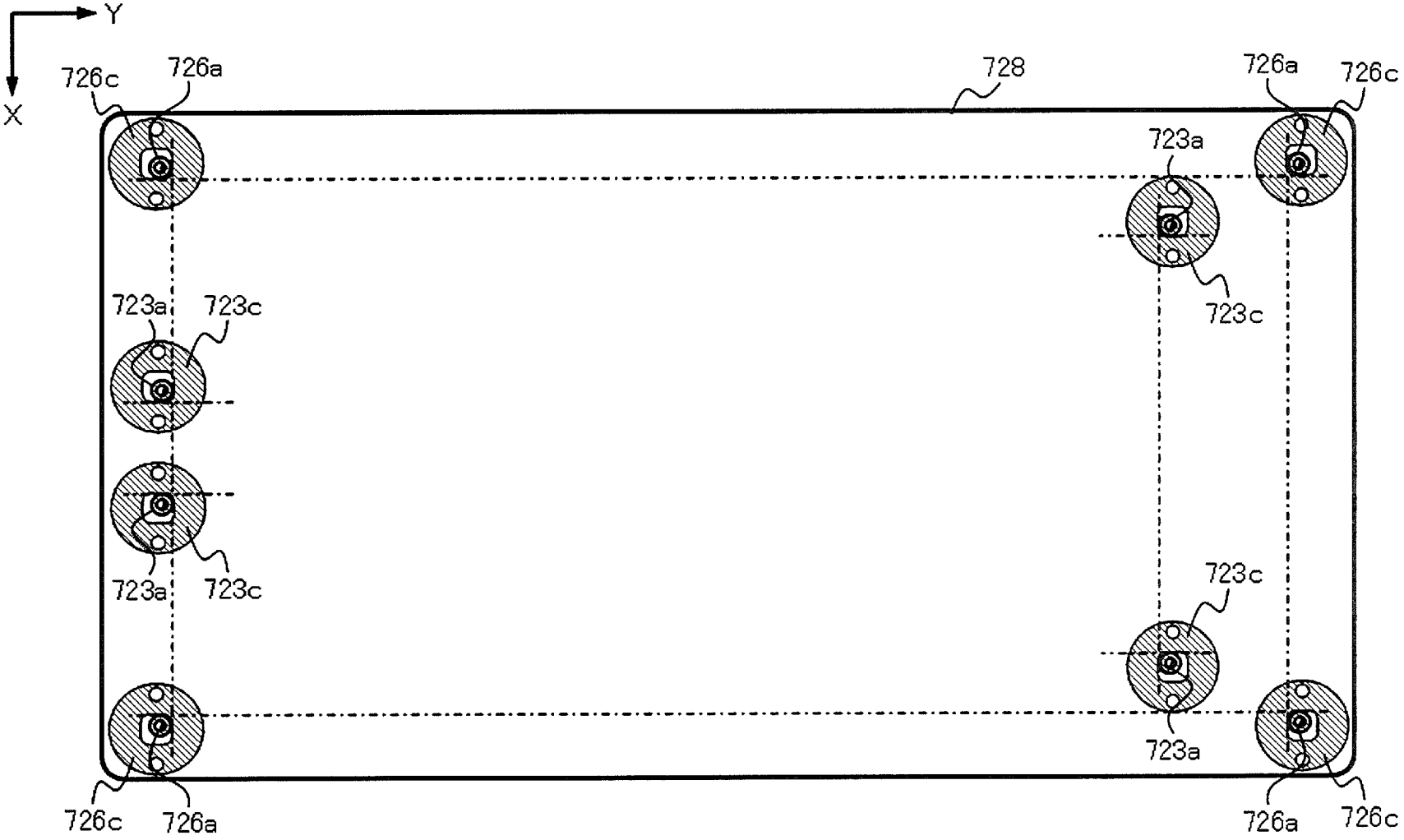
FIG. 8 is a schematic plan view of the wiping device illustrating a configuration of guide bushes.

FIG. 8 is a schematic plan view of the wiping device 72 illustrating a configuration of the guide bushes 723*c* and 726*c*.

As described above, the wiping device 72 includes the guide bushes 723*c* and 726*c* at the portions of the base plate 728 through each of which the support rod 723*a* of the wiper support plate 723 passes and the portions of the base plate 728 through each of which the support rod 726*a* of the wiper cover 726 passes.

When the lifting device 725 moves the base plate 728 toward the head plate 21, the upper surface of the wiper cover 726 comes into contact with the lower surface of the head plate 21, and the wiper cover 726 is no longer lifted as illustrated in FIG. 4B. At this time, a posture of the wiper cover 726 follows the lower surface of the head plate 21.

Thus, if the head plate 21 is not horizontal, the support rods 726*a* protruding from the lower surface of the wiper cover 726 are also inclined so that an axes of the support rods 726*a* become not vertical. If the wiper cover 726 includes a portion through which the support rod 726*a* passes as a circular through-hole having a diameter corresponding to a diameter of the support rod 726*a*, a load in an oblique direction is applied to the support rod 726*a*.

As a result, the "biting" occurs between the support rod 726*a* and the base plate 728. The "biting" causes a problem in a lifting operation of the lifting device 725 so that the wiper 722 may not properly protruding from the wiper cover 726. This problem of the "biting" also occurs between the support rod 723*a* supporting the wiper support plate 723 and the base plate 728.

Thus, the wiping device 72 according to in this variation (second embodiment) includes the guide bushes 723*c* and 726*c* having openings larger than the diameters of the support rods 723*a* and 726*a* at portions of the base plate 728 through which the support rods 723*a* and 726*a* pass. The openings of guide bushes 723*c* and 726*c* have a rectangular shape as illustrated in FIG. 8.

In a plan view of the base plate 728 in which the wiper cover 726 is in a horizontal state as illustrated in FIG. 8, the support rods 723*a* and 726*a* are positioned in the openings of the guide bushes 723*c* and 726*c* so that the support rods 723*a* and 726*a* are disposed at innermost positions of the openings (toward a center of the base plate 728) with respect to the rectangular openings of the guide bushes 723*c* and 726*c*.

The base plate 728 has a substantially rectangular shape in a plan view of the base plate 728. The support rods 723*a* and 726*a* are disposed at innermost positions of the rectangular openings of the guide bushes 723*c* and 726*c* toward the center of the rectangular base plate 728 in the plan view of the base plate 728.

When the wiper cover 726 is in a horizontal state, surfaces of two inner sides of the rectangular openings of the guide bushes 723*c* and 726*c* guide a vertical movement of the support rods 723*a* and 726*a* while positioning and holding the support rods 723*a* and 726*a*.

On the other hand, when the wiper cover 726 is not in a horizontal state but in an inclined state, gaps in the rectangular openings of the guide bushes 723*c* and 726*c* can cancel the "biting".

As described above, the wiper cover 726 includes the support rod 726*a* that guides the vertical movement of the wiper cover 726 with respect to the base plate 728, and the support rod 726*a* is inserted through the opening in the base plate 728. A size of the opening in the base plate 728 is larger than a diameter of the support rod 726*a*.

As described above, the wiper support plate 723 includes the support rod 723*a* that guides the vertical movement of the wiper support plate 723 with respect to the base plate 728, and the support rod 723*a* is inserted through the opening in the base plate 728. A size of the opening in the base plate 728 is larger than a diameter of the support rod 723*a*.

Thus, even when the wiper cover 726 or the wiper support plate 723 is inclined with respect to the horizontal direction (X-Y direction), the wiper cover 726 or the wiper support plate 723 can smoothly and vertically moves with respect to the base plate 728 without the "biting".

Figure 9A:
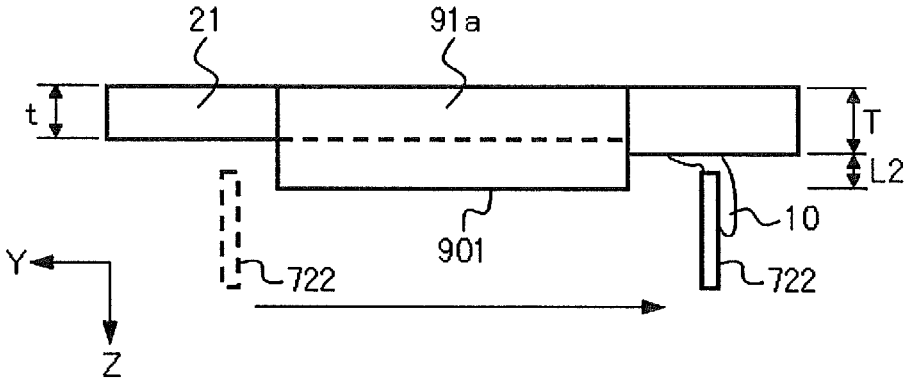
FIGS. 9A and 9B are schematic cross-sectional views of an ink dripping prevention structure.
Figure 9B:
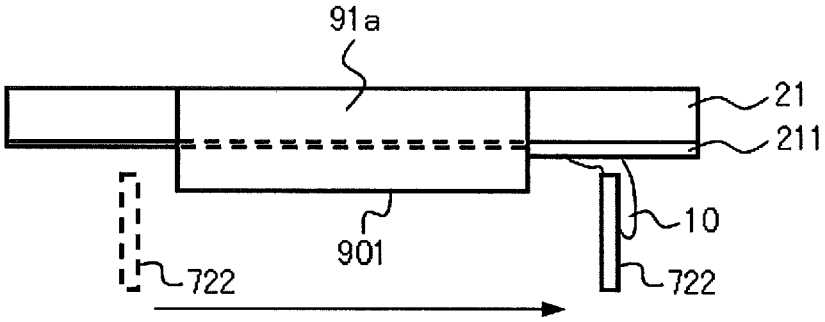

FIGS. 9A and 9B are schematic cross-sectional views of an ink dripping prevention structure.

FIG. 9A is a schematic side view of the ink dripping prevention structure.

FIG. 9B is a schematic side view of another embodiment of the ink dripping prevention structure.

The wiper 722 moves to the negative-side in the Y-direction with respect to the nozzle surface 901 of the head 91*a* as indicated by arrow in FIG. 9A so that the wiper 722 wipes the nozzle surface 901 of the head 91*a*. When the wiper 722 wipes the nozzle surface 901, the ink 10 may be splashed by an elastic force of the wiper 722 at a moment when the wiper 722 separates from the nozzle surface 901.

Then, the splashed ink 10 adheres to and accumulates on a lower surface of the head plate 21 and an inner (lower) end of the wiping device 72. Particularly, when the ink 10 adhering to the lower surface of the head plate 21 is accumulated, the ink 10 may be dripped from the lower surface of the head plate 21 and may fall onto the recording medium during formation (recording) of image on the recording medium so that a recording product may become defective. The above-described phenomenon is also referred to as "an ink dripping".

A thickness "T" of the head plate 21 on the rear side (the negative-side in the Y-direction with respect to the head 91*a*) is made thicker than the thickness "t" of the head plate 21 on a front side (the positive-side in the Y-direction with respect to the head 91*a*) to prevent the ink dripping in this second variation (third embodiment). In FIG. 9A, the "rear side" of the head plate 21 is disposed right side of the head 91*a*, and the front side of the head plate 21 is disposed left side of the head 91*a*.

The above configuration can lower a position of the lower surface on the rear side (the negative-side in the Y-direction with respect to the head 91*a*) of the head plate 21 toward the wiper 722. A distance "L2" between the lower surface of the head plate 21 on the rear side (negative-side in the Y-direction) and the nozzle surface 901 is set to 0.1 mm to 2.0 mm in this second variation (third embodiment). Thus, the wiper 722 can reach the ink 10 that has splashed to the rear side of the head 91*a* (head plate 21) and can prevent the ink dripping as illustrated in FIG. 9A.

A difference in a thickness between the rear side and the front side of the head plate 21 may be provided by processing the head plate 21 itself as illustrated in FIG. 9A or may be provided via an intermediate member as illustrated in FIG. 9B.

In FIG. 9B, a bracket 211 as the intermediate member is used between the head 91 and the head plate 21. That is, a difference in thickness between the rear side and the front side of the head plate 21 is formed by the bracket 211. The above configuration of the bracket 211 (intermediate member) also functions in the same manner as the configuration illustrated in FIG. 9A. Thus, the head plate 21 including the bracket 211 (intermediate member) can prevent the ink dripping.

As described above, the thickness "T" of the head plate 21 on the rear side is made larger than the thickness "t" of the head plate 21 on the front side with respect to the nozzle surface 901 in the negative-side in the Y-direction as indicated by arrow in FIG. 9B.

The wiper 722 wipes the nozzle surface 901 of the head 91 in one direction (negative-side in the Y-direction). The thickness "T" of a downstream end of the head plate 21 in said one direction (negative-side in the Y-direction) is larger than the thickness "t" of an upstream end of the head plate 21 in said one direction (negative-side in the Y-direction).

Thus, the wiper 722 can reach the ink 10 that has splashed to the rear side of the head 91*a* (head plate 21) and can prevent the ink dripping as illustrated in FIG. 9A.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

The above-described embodiments are one of examples and, for example, the following Aspects 1 to 5 of the present disclosure can provide the following advantages.

[Aspect 1]

A liquid discharge apparatus (inkjet recording apparatus 1) according to Aspect 1 includes: a head (heads 91 to 94) including a nozzle surface 901 in which nozzles 902 are formed, the head (heads 91 to 94) configured to discharge a liquid (ink) from the nozzles 902; a head plate 21 holding the head (heads 91 to 94); and a wiping device 72 comprising: a wiper 722 configured to wipe the nozzle surface 901 of the head (heads 91 to 94); a wiper support plate 723 holding the wiper 722, the wiper support plate 723 vertically movable with respect to the head plate 21; a wiper cover 726 between the head plate 21 and the wiper support plate 723, the wiper cover 726 configured to cover the wiper 722; a lifting device 725 configured to vertically move the wiper support plate 723 and the cover 726 toward the head plate 21 until the wiper cover 726 contacts the head plate 21; and an adjuster (adjustment screw 727) between the wiper support plate 723 and the cover 726, the adjuster (adjustment screw 727) configured to adjust a position of the wiper support plate 723 with respect to the wiper cover 726.

The liquid discharge apparatus (inkjet recording apparatus 1) according to the Aspect 1 can easily adjust a position of a cleaning member (wiper 722) to contact with a liquid ejecting surface (nozzle surface 901).

[Aspect 2]

In the liquid discharge apparatus (inkjet recording apparatus 1) according to Aspect 2, the adjuster (adjustment screw 727) includes an adjustment screw 727 protruding from the wiper cover 726 toward the wiper support plate 723, and the lifting device 725 is configured to vertically move the wiper support plate 723 and the wiper cover 726 toward the head plate 21 until the wiper cover 726 contacts the head plate 21 and the wiper support plate 723 contacts the adjustment screw 727.

The liquid discharge apparatus (inkjet recording apparatus 1) according to the Aspect 2 can maintain the parallelism of the wiping device 72 with respect to the head plate 21 (liquid discharge surface holding member) only by obtaining an accuracy of the wiping device 72 (cleaning device) alone. Thus, the wiping device 72 can reduce occurrence of a skill difference of workers in a height adjustment operation of the wipers 722 (cleaning member).

[Aspect 3]

In the liquid discharge apparatus (inkjet recording apparatus 1) according to Aspect 3, the wiping device 72 further includes: a base plate 728; a first spring 723*b* configured to push the wiper support plate 723 away from the base plate 728; a second spring 726*b* configured to push the cover 726 away from the base plate 728, and the lifting device 725 configured to vertically move the base plate 728 toward the head plate 21 until the wiper cover 726 contacts the head plate 21 and the wiper support plate 723 contacts the adjuster 727.

[Aspect 4]

In the liquid discharge apparatus (inkjet recording apparatus 1) according to Aspect 4, the wiper support plate 723 includes a support rod 723*a* guiding a vertical movement of the wiper support plate 723 with respect to the base plate 728, the base plate 728 includes an opening having a size larger than a diameter of the support rod 723*a*, and the support rod 723*a* is inserted through the opening in the base plate 728.

The liquid discharge apparatus (inkjet recording apparatus 1) according to Aspect 3 and Aspect 4 can prevent an occurrence of the "biting" even when the wiper cover 726 (cover member) or the wiper support plate 723 (cleaning member support member) is inclined. Thus, the wiper cover 726 (cover member) or the wiper support plate 723 (cleaning member support member) can smoothly and vertically move with respect to the base plate 728 (base member).

[Aspect 5]

In the liquid discharge apparatus (inkjet recording apparatus 1) according to Aspect 5, the wiper 722 wipes the nozzle surface 901 of the head (heads 91 to 94) in one direction (negative-side in the Y-direction); and a thickness "T" of a downstream end of the head plate 21 in said one direction (negative-side in the Y-direction) is larger than a thickness "t" of an upstream end of the head plate 21 in said one direction (negative-side in the Y-direction).

In the liquid discharge apparatus (inkjet recording apparatus 1) according to the Aspect 5, the wiper 722 (cleaning member) can reach a liquid splashed on the inner side of the nozzle surface 901 (liquid discharge surface) to prevent the liquid dripping (falling).

The liquid discharge apparatus according to the present embodiment can easily adjust a position of a cleaning member contacting with a liquid discharge surface.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The invention claimed is:

1. A liquid discharge apparatus comprising:

a head including a nozzle surface having nozzles, the head configured to discharge a liquid from the nozzles;

a head plate holding the head; and a wiping device comprising:

a wiper configured to wipe the nozzle surface of the head;

a wiper support plate holding the wiper, the wiper support plate vertically movable with respect to the head plate;

a cover between the head plate and the wiper support plate, the cover configured to cover the wiper;

a lifting device configured to vertically move the wiper support plate and the cover toward the head plate until the cover contacts the head plate; and an adjuster between the wiper support plate and the cover, the adjuster configured to adjust a position of the wiper support plate with respect to the cover.

2. The liquid discharge apparatus according to claim 1, wherein the adjuster includes an adjustment screw protruding from the cover toward the wiper support plate, and the lifting device is configured to vertically move the wiper support plate and the cover toward the head plate until the cover contacts the head plate and the wiper support plate contacts the adjustment screw.

3. The liquid discharge apparatus according to claim 2, wherein the wiper support plate includes a pin, and the lifting device is configured to vertically move the wiper support plate and the cover toward the head plate until the cover contacts the head plate and the pin of the wiper support plate contacts the adjustment screw.

4. The liquid discharge apparatus according to claim 1, wherein the wiping device further comprises:

a base plate;

a first spring configured to push the wiper support plate away from the base plate;

a second spring configured to push the cover away from the base plate, and the lifting device is configured to vertically move the base plate toward the head plate until the cover contacts the head plate and the wiper support plate contacts the adjuster.

5. The liquid discharge apparatus according to claim 4, wherein the cover includes a support rod guiding a vertical movement of the cover with respect to the base plate, the base plate includes an opening having a size larger than a diameter of the support rod, and the support rod is inserted through the opening in the base plate.

6. The liquid discharge apparatus according to claim 5, wherein the opening has a rectangular shape.

7. The liquid discharge apparatus according to claim 6, wherein the base plate has a rectangular shape in a plan view, and the support rod is disposed at an innermost position in the opening toward a center of the base plate in the plan view.

8. The liquid discharge apparatus according to claim 4, wherein the wiper support plate includes a support rod guiding a vertical movement of the wiper support plate with respect to the base plate, the base plate includes an opening having a size larger than a diameter of the support rod, and the support rod is inserted through the opening in the base plate.

9. The liquid discharge apparatus according to claim 8, wherein the opening has a rectangular shape.

10. The liquid discharge apparatus according to claim 9, wherein the base plate has a rectangular shape in a plan view, and the support rod is disposed at an innermost position in the opening toward a center of the base plate in the plan view.

11. The liquid discharge apparatus according to claim 1, wherein the wiper wipes the nozzle surface of the head in one direction;

and a thickness of a downstream end of the head plate in said one direction is larger than a thickness of an upstream end of the head plate in said one direction.

* * * * *